United States Patent [19]

Chang

[11] Patent Number: 4,545,394

[45] Date of Patent: Oct. 8, 1985

[54] COIN COUNTER TROUGH

[76] Inventor: Chen-Kun J. Chang, 215 Powell St., San Francisco, Calif. 94102

[21] Appl. No.: 537,573

[22] Filed: Sep. 30, 1983

[51] Int. Cl.[4] ..... G07D 9/02

[52] U.S. Cl. ..... 133/8 R

[58] Field of Search ..... 133/1 R, 1 A, 8 R, 8 A; 53/254; 414/675

[56] References Cited

U.S. PATENT DOCUMENTS 2,268,101 12/1941 Allard ..... 133/1 R

FOREIGN PATENT DOCUMENTS 632030 12/1961 Canada ..... 133/8 R 529232 6/1955 Italy ..... 133/8 R

*Primary Examiner*—Stanley H. Tollberg

[57] ABSTRACT

An elongated trough-like body has inclined sides deeper and wider than the largest coin handled having a grooved bottom with a radius larger than the largest coin handled enabling the unaligned coins to be shaken and formed into an aligned stack where their count is indicated by adjacent scales.

1 Claim, 1 Drawing Figure

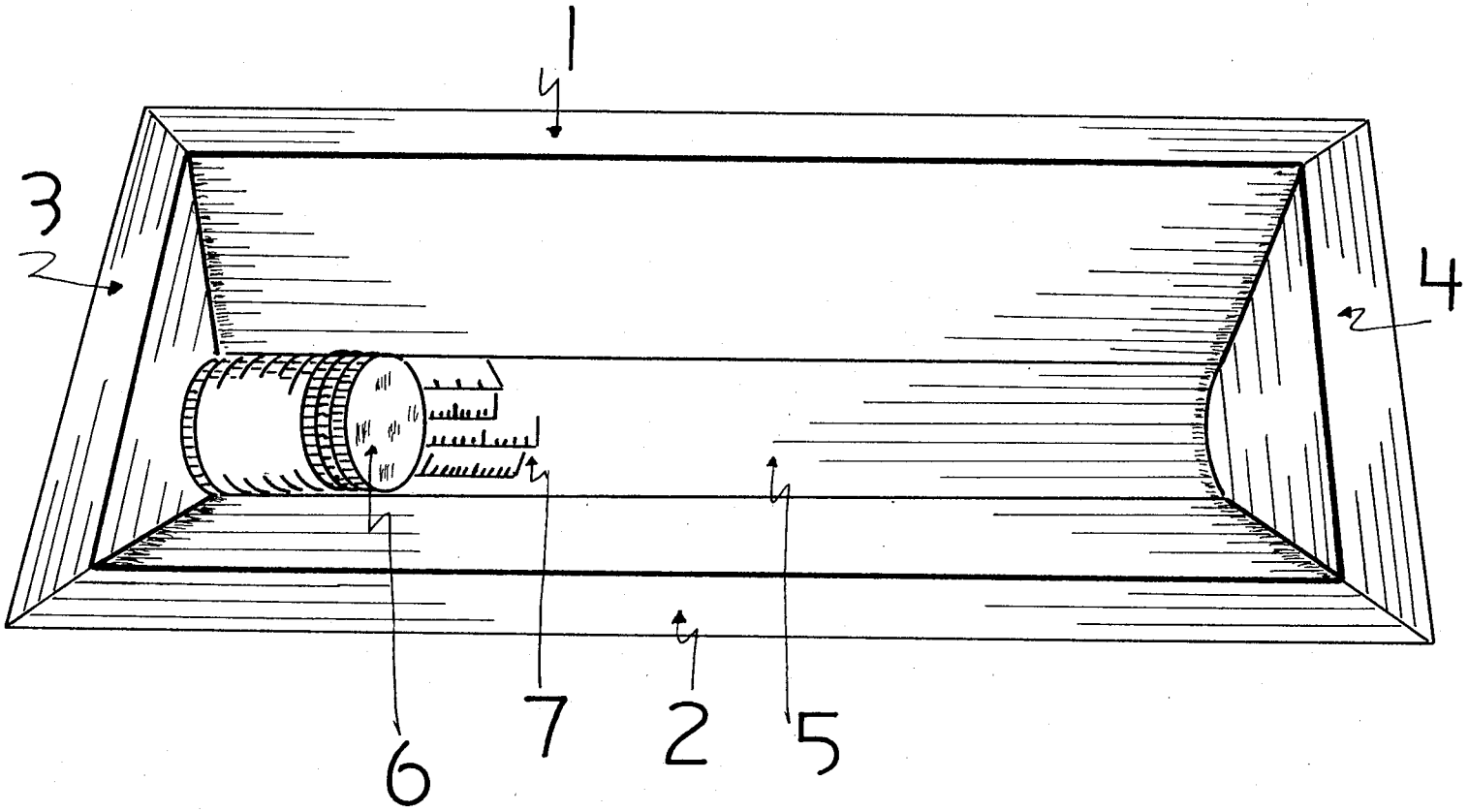
1
2
3
4
5
6
7

COIN COUNTER TROUGH

BACKGROUND OF THE INVENTION

This invention is in the field of coin counters and in the general field of coin stacking, such as is done at businesses and banks.

In past years, there has been a great deal of development in coin counting machines. There are also many proposals for counting coins by measuring the length of the stack of coins to be counted. These proposals can be classified into two catagories, vertical tube type and horizontally grooved body type. In the first type, there are many patents issured, such as U.S. Pat. Nos. 961,832, 1,710,086, 1,407,140, 2,150,473, 2,527,389, 2,996,864, 3,093,148, 3,085,378, 3,206,914, 3,999,563, 4,091,597, 4,244,157 and etc. In U.S. Pat. No. 4,244,157, a funnel was proposed to be attached to the upper end of the tube to collect the coins to be counted. The main disadvantage of this type is that one tube can not count various denominations of coins unless by selectively adjusting the inside diameter of the tube. Another disadvantage is that the tube can only count coins stacks not loose, even by attaching a funnel on the upper end of the tube, loose coins will always plug the funnel or the tube.

In the second type, the horizontally grooved body type, the eariest patent I can find is U.S. Pat. No. 202,188 issured to James Ostergard in 1878 for counting predetermined number of coins, there is no measuring scale on the device. The counter with measuring scale on it is proposed in U.S. Pat. No. 208,902 issured to Charles H. Fuller in 1878. His device can measure only one denomination of coins and it only takes coins already stacked. U.S. Pat. No. 3,107,467 issured to Francis H. Gates in 1959 proposed a five grooves device with different groove sizes. His device also can count only pre-stacked coins. U.S. Pat. No. 4,109,668 issured to Joseph J. Malacheski in 1978 proposed a four groove device, one groove on each side of a block, to count four denominations of coins, 25¢, 10¢, 5¢, and 1¢. There is no measuring scale but marks of $10., $5., $2., and $0.50 on it. His device was designed mainly for wrapping purpose. This device also can count only prestacked coins.

The coin counter in my invention has only one grooved body, but can count various denominations of coins. On the grooved body, there are the same number of measuring scales as the number of denominations of coins to be counted. There is a rectangle-shape funnel attached to the top of the grooved body. So it can receive coins loose and do the job of stacking, a required process before measuring. To my knowledge, there is no earlier patent on coin counters having the same propositions as I have in my invention.

BRIEF SUMMARY OF THE INVENTION

The main goal of this invention is to provide a simple, inexpensive, and practical coin counter for retail business men. Such a counter must be able to replace the basic way of counting coins, one by one, and be accepted by retail business men to count their coins in their cash register machines. The counter in this invention does not have a moving part. The counter comprises an elongate grooved body, having a semi-cylindrical surface of radius slightly greater than the radius of the largest coin to be counted among different denominations. The length of the grooved body is at least four times the length of the stack of coins to be counted. There are various measuring scales on the inner surface of the grooved body for measuring various denominations of coins. The top of the grooved body is attached to a rectangle-shape funnel. The counter so constructed can very quickly stack the coins loose and then measure the number of coins.

BRIEF DESCRIPTION OF THE DRAWING

The drawing shows the coin counter with the coins to be counted already stacked.

DETAILED DESCRIPTION OF THE INVENTION

The coin counter of this invention is generally indicated in FIG. 1 and comprises an elongate grooved body 5, and four walls 1, 2, 3, and 4. The two walls 3 and 4 are vertical and the other two walls 1 and 2 are inclined. These four walls form a rectangle-shape funnel. The rectangle-shape funnel is attached to the top of the grooved body 5. The length of the grooved body 5 is much longer than the length of the stack of coins to be counted 6, at least about four times. There are various measuring scales 7 on the inner surface of the grooved body to count various denominations of coins. The inner surface of the grooved body has a semi-cylindrical surface of radius slightly greater than the radius of the largest coin to be counted among various denominations. The rectangle-shape funnel is used to receive coins loose and to help stacking the coins. The reason for using a very long grooved body 5 is that there must be enough space for the coins to spread out on the grooved body. Therefore, the coins will not stay on the inclined walls 1 and 2 of the rectangle-shape funnel or rest on the the top of other coins. The most stable positions for the coins to make a final rest is on the inner surface of the grooved body, if enough space is provided. So, by making the counter vibrate or using other kind of motions such as back and forth, all the coins will rest on the inner surface of the grooved body or will have a direct contact with the bottom of the groove finally. Then, the coins can be stacked at once by pushing them to one end of the grooved body. The above described process of stacking and counting can be done in few seconds. This is faster than the counting, one by one by hands along.

I claim:

1. A coin counter, comprising an elongate body having a groove therein, said groove having both ends closed and having a curved surface with a radius of curvature slightly greater than the radius of curvature of the largest coin among a predetermined set of different denominations of coins to be counted, and an elongate trough with high inclining sides attached to and extending upwardly and outwardly from the top of said grooved body, the depth of said groove when combined with said trough being more than 125% of the diameter of said largest coin, the width of the top of said trough being more than 1.5 times the diameter of said largest coin, said trough communicating with the sides of said groove for collecting and directing coins into said groove when they are loosely deposited into said trough, whereby said grooved body will enable loosely-deposited coins to be easily shaken to lie flat and be rearranged manually by rotation, if in an improper position, and by pushing, into vertical positions in a horizontal stack aligned with and at the bottom of said groove, said grooved body being provided with a plurality of numbered scales at convenient positions for counting coins of various denominations when said stack extends from one end of said groove.

* * * * *